United States Patent [19]

Maust

[11] 4,226,049

[45] Oct. 7, 1980

[54] SECURITY VENTILATING SYSTEM

[76] Inventor: Charles I. Maust, 45 Blackburn Pl., Summit, N.J. 07901

[21] Appl. No.: 35,475

[22] Filed: May 3, 1979

[51] Int. Cl.[2] ..... E06B 9/02

[52] U.S. Cl. ..... 49/57; 49/168; 49/450; 49/463

[58] Field of Search ..... 49/50, 55, 57, 62, 54, 49/168, 169, 171, 463, 449, 450

[56] References Cited

U.S. PATENT DOCUMENTS

| | | | |
|---|---|---|---|
| 1,507,478 | 9/1924 | Gray | 49/463 X |
| 3,698,883 | 10/1972 | DiFazio | 49/449 |
| 3,878,645 | 4/1975 | Porter | 49/169 |

FOREIGN PATENT DOCUMENTS

| | | | |
|---|---|---|---|
| 1067938 | 5/1967 | United Kingdom | 49/450 |

*Primary Examiner*—Kenneth Downey
*Attorney, Agent, or Firm*—Martha G. Pugh

[57] ABSTRACT

A security ventilating system for an arrangement of coordinated sliding doors comprising one or more lift-out metal grills each constructed to fit between one partially opened door or window and the door or window frame at each of several different openings. For a typical arrangement in which a left-hand door opens by sliding to the right, the left-hand vertical bar of a lift-out grill is secured in a vertical channel fitted to the inside edge of the left vertical channel of the door frame. The right-hand vertical bar and several of the parallel vertical bars of the grill are designed to fasten in alternative open positions to a series of short vertically-aligned channels fastened to the left-hand stile of the partially open door. A centrally disposed horizontal stud fixed to each of the vertical bars at the different ventilation openings is constructed to engage the door handle of the open door. One additional security feature is a rough-faced nail or stud, fastened inside of the door frame to the end of a cord or chain, which keys into aligned holes along the top of the inner door frame and through the tops of the overlapping door panels corresponding to each of a plurality of openings. Other security features in combination with the invention include studs designed to extend vertically into the bottom of both the fixed and sliding doors. It is understood that the security system of this invention can be applied with suitable modifications to various arrangements of fixed and laterally sliding doors and windows.

11 Claims, 20 Drawing Figures

SECURITY VENTILATING SYSTEM

BACKGROUND OF THE INVENTION

This relates in general to security ventilating systems, more particularly as such systems are applied to residential and business premises having laterally rolling or sliding doors and/or windows.

In the present-day state of society, breaking and entering into residential and business premises is all too common. Accordingly, it is necessary to augment the conventional types of locks, which skilled burglers can easily circumvent, additional security is especially needed in the case of horizontally sliding glass doors or windows of the types employed in so many modern houses, apartments and stores. During warm weather, it is desirable to open such doors or windows for ventilation; and even if a screen door is interposed in the opening, it can be readily and quietly cut and opened. Moreover, when the doors or windows are closed, the intruder breaks or cuts the glass, and reaches through to unlock the door by manipulating the handle from the inside, which is located in a conventional position visible from the outside; or he may use a tool to force such doors or windows up to unlock, unlatch or force conventional locks to release, actually removing the door or window from its track.

Numerous security systems have been devised in accordance with the prior art, such as various types of grills, window guards, and screens; but none of them is suitable for use with sliding glass doors or windows which are opened to different positions. Moreover, they are either too expensive or cumbersome to install, or the locks are readily identifiable from the outside and easily removed by a skilled burgler having simple tools; or they are too difficult to open to enable escape from an indoor fire. Furthermore, some of the systems of the prior art are too massive and heavy for the purposes contemplated for the security ventilating system of the present invention and especially for adaptation to existing doors or window frames.

Accordingly, it is the principal object of the present invention to provide an improved security system applicable to an arrangement of sliding doors comprising either a single sliding door or window or a plurality of fixed and sliding doors or windows of various conventional arrangements and of a variety of heights and widths.

A more particular object of the invention is to provide a system which is simple, positive and inexpensive to install for current, or existing old installations and buildings.

A further object of the invention is to provide a security system which can be locked in place when the sliding doors or windows are opened to each of a series of different positions for the purposes of variable degrees of ventilation.

Still another object of the invention is to provide a security system which is not visible to potential intruders from the outside of the doors or windows, and which is not, therefore, readily located or removed.

Another object of the invention is to fully cope with the potential intruder's attempt to unlock, by either raising or sliding, the sliding door or window.

These and other objects are attained in a security system in accordance with the present invention which is particularly applicable to an arrangement of sliding doors or windows. Such a system comprises means adapted to be interposed into the space between the door or window jamb casing and the door or window frame when one of the group of sliding doors or windows is partially opened for ventilation; and which provides additional locking means when the doors or windows are tightly closed. This arrangement comprises a light-weight, high-strength metal lift-out grill which is constructed to be fitted into the void created when one of the sliding doors or windows is opened, the length and width of the grill varying in accordance with the size of the door or window frame. The left-hand vertical bar of the lift-out grill is secured in an auxiliary channel which is fastened along the inside edge of the left-hand door or window frame. Either the right-hand vertical bar of the grill, or alternatively, one of the series of parallel vertical bars thereof, fastens into a series of vertically aligned channels set on the inside edge of the door or window frame. Also, a horizontally directed lug fastened to each of the vertical bars is constructed to be interposed below the door or window handle to further secure the grill in place. Lastly, a strong rough-faced pin or stud is connected to a short chain or cord inside of the door frame; and said pin or stud is constructed to key into one of a series of fairly snug holes perforating the inner edge of the upper door or window corresponding to each of a series of door or window opening positions. This pin or stud passes through the upper frames of the overlapping sliding doors or windows, but does not pass through the outer edge of the door or window frame channel, so that it cannot be seen from the outside.

Another security feature designed to prevent the movable door from being lifted out of its bottom track by a screw driver or crow bar is a square metal bar or tube mounted in the top trough above the sliding door and extended beyond the maximum security opening of the door so that its mounting bolt is never available to a potential intruder. Another security feature is to have the inner flanges of the track actually extend a short distance into recesses in the lower rails of the inner and outer doors, so that the sliding doors slide along these rails. This is not, per se, a novel feature; but in common with the other features described, tends to make a burgler-proof system.

For convenience of description, the security system of the present invention is described hereinafter with reference to an arrangement consisting of one fixed door and one sliding door which is adapted to slide laterally along the inner face of the fixed door so that in completely open position, it is colinear with the fixed door. It will be understood, however, that with slight modification, the security system of the present invention may be applied to numerous variations of this arrangement. For example, the fixed and sliding doors may be reversed in direction. The arrangement may comprise a fixed door at the center with sliding doors at its opposite ends which are adapted to slide toward one another, along the inner face of the fixed door, to open. Alternatively, one sliding door may be adapted to slide along the outer face of the fixed door, and the other sliding door may be adapted to slide along the inner face of the fixed door. In still another arrangement with the fixed door in the center, the sliding doors, in open positions, may be stored in recesses in the wall, moving toward the fixed door to close. Other arrangements will occur to those skilled in the art.

These and other objects, features and advantages will be apparent to those skilled in the art when studying the specification hereinafter with reference to the attached drawings.

SHORT DESCRIPTION OF THE DRAWINGS

Figure 4B:
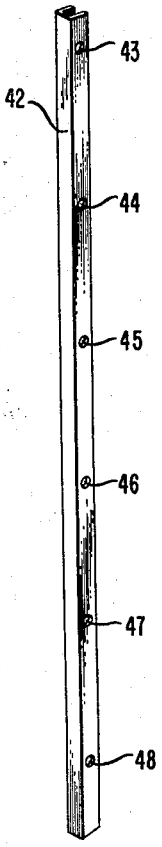
Figure 4A:
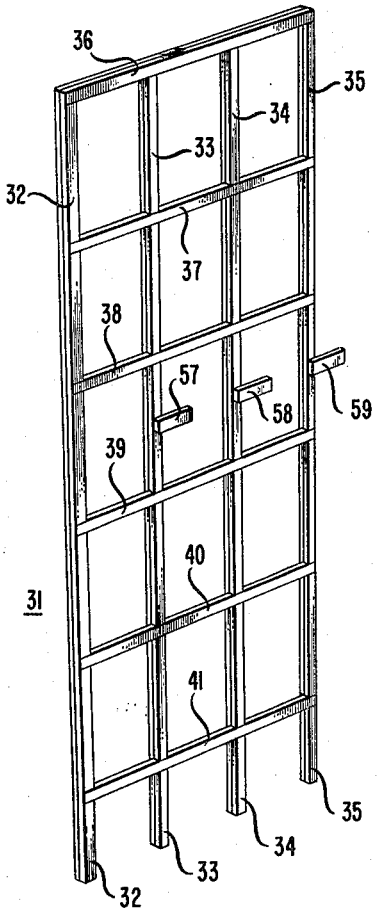
Figure 4C:
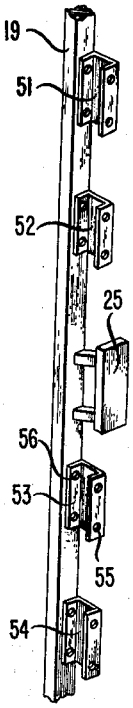

FIGS. 4A, 4B, and 4C show, in perspective, the principal elements added in accordance with the present invention, to the sliding door assembly, which include in FIG. 4A the lift-out grill; in FIG. 4B, the left-hand door frame grill casing; and in FIG. 4C, a series of vertically-aligned channels for the sliding door stile.

Figure 5:
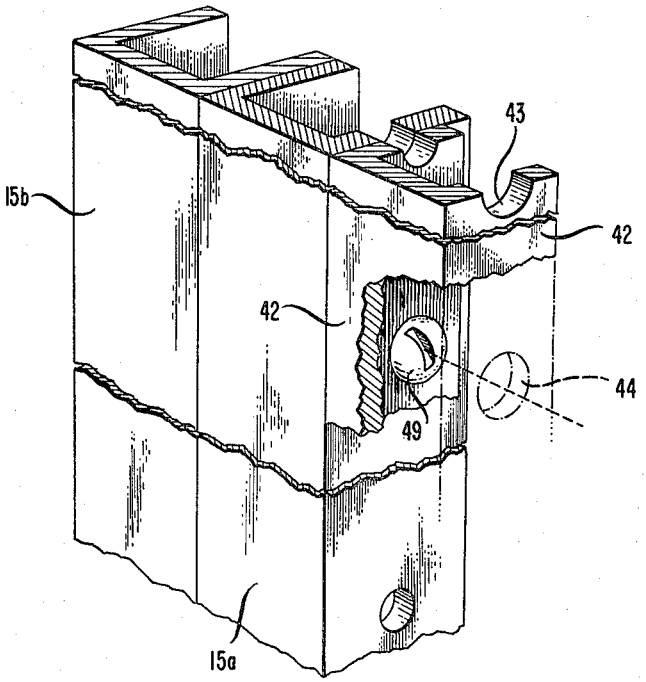

FIG. 5 is an enlarged fragmentary showing, in perspective, of the upper end of the left-hand door frame, including the left-hand door frame grill casing, as shown in FIG. 4B.

Figure 6:
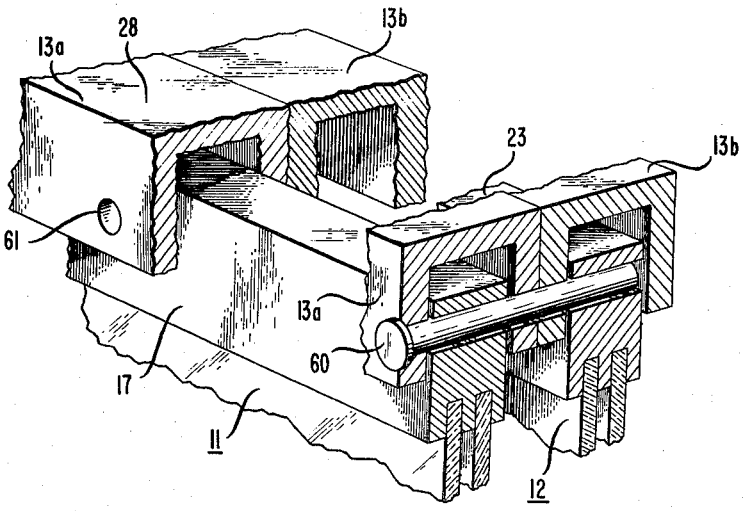

FIG. 6 is an enlarged fragmentary perspective showing of the central portion of the upper double-door channels with the rolling or sliding doors in over-lapping closed relation, and the locking stud in place.

Figure 7:
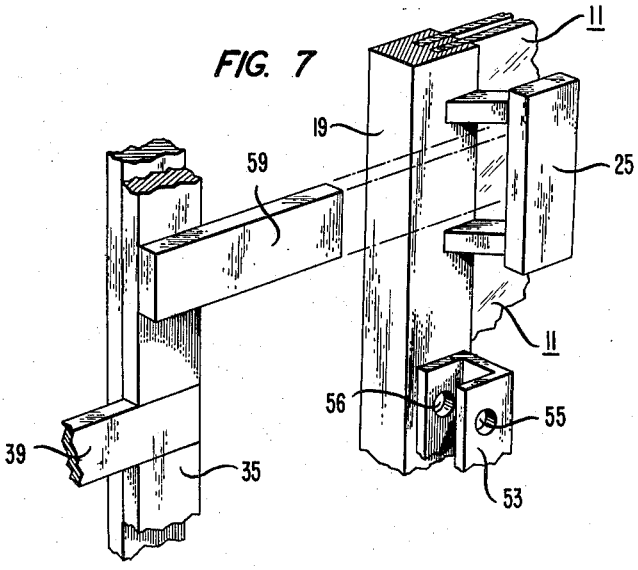

FIG. 7 is an enlarged exploded view of a horizontal locking lug attached to one of the vertical members of the lift-out grill being moved into locking relation with the door handle.

Figure 1:
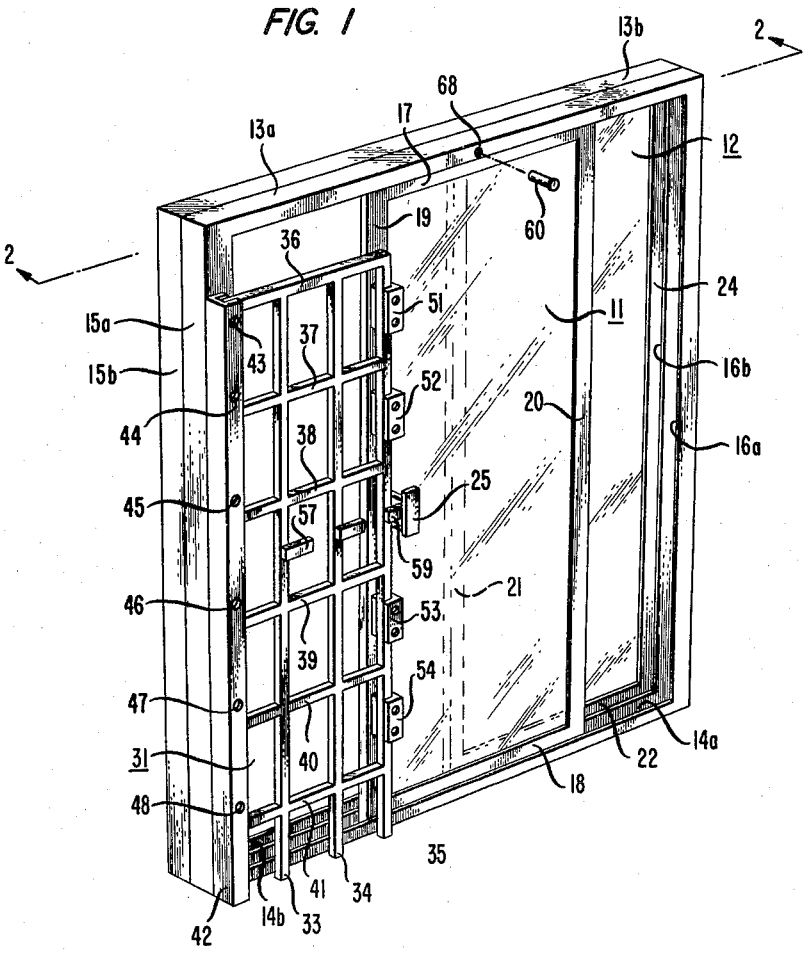
FIG. 1 is a perspective view from the left-hand corner, of the security system of the present invention, including a lift-out grill as installed in the door frame, which includes a conventional pair of rolling glass doors in partially open position.
Figure 8A:
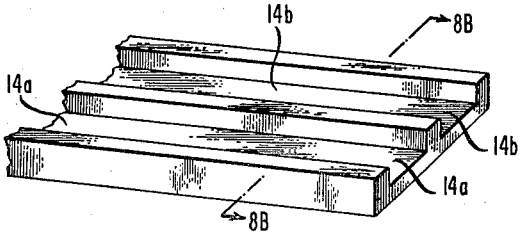
Figure 8B:
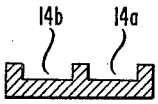

FIGS. 8A and 8B show in perspective, and cross-section, respectively, the double-channel bottom door casing 14*a*, 14*b* of FIG. 1.

Figure 9:
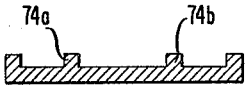
Figure 10:
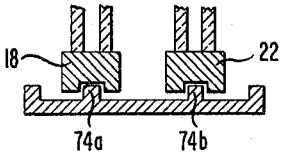

FIG. 9 shows, in section, a modification of FIG. 8B in which the central flange has been removed, and replaced by two parallel tracks which ride in longitudinal recesses in the bottom rails of the inner and outer doors, as shown in section in FIG. 10.

Figure 11:
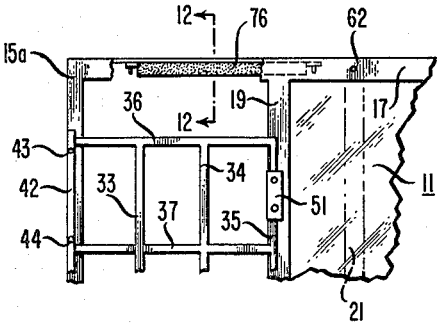

FIG. 11 shows in side elevation the top portion of the assemblage of FIG. 1, with the upper inside flange of the door frame partially broken away to show a rod or tube mounted in the top trough above the sliding door and extending beyond the widest security opening of the door.

Figure 12:
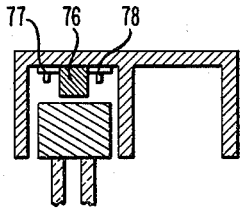

FIG. 12 is an enlarged fragmentary showing in section indicated by the arrows 12-12 of FIG. 11 of the rod or tube disposed in the top rail above the slidable door.

FIGS. 13A, 13B, 13C, 13D and 13E are schematic plan views of various fixed and movable door or window arrangements to which the present security system might be applied with suitable adjustment.

DETAILED DESCRIPTION OF THE INVENTION

FIG. 1 of the drawings shows the security ventilating system of the present invention, completely assembled, and in place in cooperative arrangement with a conventional pair of sliding or rolling doors 11 and 12. These are of a type used in many buildings of modern design for ingress and egress between a room at any level and an outdoor yard or patio or upper platforms. In the present example, the two doors comprising a movable door 11 and a fixed door 12, are mounted in a metal door casing 5 feet 11¼ inches in overall width and 6 feet 7½ inches high. These are equipped with a double-channeled bottom track 14*a*, 14*b* (not shown) which is 3 11/16 inches wide; a parallel substantially aligned double-channeled top track 13*a*, 13*b* which is 3½ inches wide (see FIG. 2); a left-hand double-track door jamb casing 15*a*, 15*b*, and a right-hand door jamb casing 16*a*, 16*b*, each 3 7/16 inches wide. The moving door 11 is 36½ inches wide; and fixed door 12 is 36 inches wide; and both are 6 feet 7 inches high. They comprise glass panels which are respectively mounted in a pair of conventional door frames for glass doors, which may, for example, be of aluminum or stainless steel. The left-hand inner door 11 has top and bottom rails 17 and 18, which enclose the upper and lower perimeters of the double panes; and in the present example are of stainless steel, or aluminum, 36½ inches long, 6 feet 6½ inches in a vertical plane. The left and right-hand door stiles 19 and 20, which respectively enclose the left and right-hand edges of the panes of door 11, are also of stainless steel or aluminum, 6 feet 7 inches long in a vertical direction, 2 inches wide horizontally, and 1⅛ inches thick. The outer fixed door 12 is equipped with substantially similar top and bottom rails 23 and 22, and left-hand and right-hand door stiles 21 and 24. The inner door 11 is mounted to slide or move laterally on small wheels mounted on the inside of the top and bottom tracks 13*a* and 14*a*; whereas the outer door 12 is mounted to move laterally on the top and bottom outside tracks 13*b* and 14*b* (not shown). This is better understood by referring to FIG. 2 which shows a plan view of the doors 11 and 12, with door 11 in partly open position in the upper track 13*a*.

The door 11 has a conventional handle 25 which projects into the interior as shown in FIG. 1, and in more detail, in FIG. 7; and which serves to move the door 11 laterally in the door frame relative to the door 12.

When the door 11 is moved to the extreme left to engage the left-hand door casing 15*a* in closed latching relation, there is a slight overlap between doors 11 and 12 at the center.

It is customary, in warm climates, to move the door 11 to the right to provide an opening for the purpose of ventilation. In accordance with my invention, I propose to interpose into the void between the left-hand door jamb casing 15*a* and the right-hand stile 19 of the door 11, a grill 31 having an overall height of 5 feet 10 inches and an overall width of 25½ inches which is shown in detail in FIG. 4A of the drawings. In the present illustration, this comprises four vertical flat metal bars 32, 33, 34 and 35, each 5 feet 10 inches long and ¾ inch by ⅛ inch in cross-section which are held 7½ inches apart in a parallel fixed relation to six horizontal bars 36 (at the top) and 37, 38, 39, 40 and 41 in lower succession, each ¾ inch by ⅛ inch in cross-section. The upper bars 36, 37 and 38 are each 12 inches apart, whereas the lower horizontal bars are spaced apart 5½ inches along the vertical bars. Preferably, the grill 31 is made of iron or steel or high strength aluminum, which cannot be readily bent, distorted in shape or cut; and the horizontal and vertical bars are attached by, say, fillet welds or brazing. It will be understood that the grill can take numerous forms, such as rods, tee-bars, or channels.

As indicated in FIGS. 4B and 5, a vertical channel 42, which is of a suitable length and width to accommodate the left-hand bar 32 of the security grill 31, is fastened to the inside vertical edge of the left-hand door jamb casing 15*a*. In the present illustrative embodiment, the channel 42 is 5 feet 10 inches long, and formed of sheet metal, such as stainless steel or high-strength aluminum, 1/16 inch thick, the internal dimensions of the U-shaped channel being 1 inch across and having ¾ inch flanges on the sides. The channel 42, the upper end of which, is shown in FIG. 4B, and in enlarged fragment in FIG. 5, connected to the left-hand door jamb 15*a*, is equipped along its inner edge-flange with a plurality of round openings 43, 44, 45, 46, 47 and 48. These are large enough to allow passage of a screw driver, which is used to secure a one-way self-tapping screw 49 through the corresponding screw holes in the vertical flange of channel 15*a* which is aligned with each of the aforesaid openings.

Referring to FIGS. 1 and 4C, there is shown a plurality of substantially identical short channels 51, 52, 53 and 54, which are installed in vertical alignment on the inner periphery of the left-hand door stile 19 of the inner, movable glass door 11. These are of a proper width to accommodate the right-hand vertical bar 35, or alternatively, each of the intermediate bars 34 and 33 of the grill 31. In the present illustration, except as to length, the general shape of the vertically-aligned channels 51, 52, 53 and 54 is substantially the same as that of the elongated left-hand channel 42, each of the short channels being 6 inches long. Each of these short channels 51, 52, 53 and 54 has near its two ends circular holes such as 55 of FIG. 7, large enough to accommodate a screw driver and screw head, and which correspond to a screw hole, such as 56, on the inner flange. The short channels 51, 52, 53 and 54 are mounted in vertical alignment along the inner left-hand edge of the door stile 19, of inner door 11, by means of one-way self-tapping screws applied through screw-holes, through the aligned openings corresponding to 55 and 56, on the outer and inner flanges of each channel. Channels 51, 52, 53 and 54 are respectively positioned along door stile 19 so that the grill 31 is held in place between channel 42, attached to the left-hand door jamb 15*a*, and the door stile 19, on the right. Channel 51 is centered on vertical bar 35 between the right-hand ends of horizontal bars 36 and 37; channel 52, between bars 37 and 38; channel 53, between bars 39 and 40; and channel 54, beween bars 40 and 41. Channels 51 and 52 may be combined; likewise, 53 and 54.

Fixed to the center of the right-hand vertical bar 35 of grill 31, and to the inner vertical bars 33 and 34, are three horizontal lugs 57, 58 and 59, each of which is directed to the right. These lugs are 2½ inches long, and ¾ inch by ¼ inch in section, and are permanently secured to the respective vertical bars by either welding, or self-tapping, one-way screws, in the manner shown in FIG. 7 of the drawings. The lug 59 is directed to be inserted under and engage the under surface of handle 25 in the manner shown when the door 11 is moved to the opening conforming to the width of the grill 31, thereby locking the grill in position. The lugs 58 and 57 are designed to operate in a similar manner when the door 11 is moved to lesser openings, respectively engaging the vertical bars 34 and 33.

Figure 2:
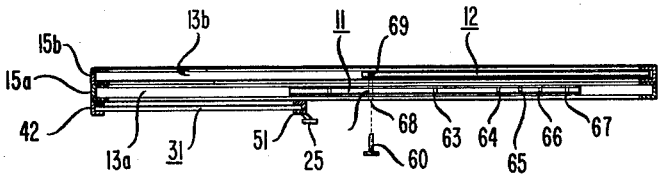
FIG. 2 is a plan view taken along the plane 2—2 of FIG. 1 showing the door jamb casing and top portion of the rolling door-frame, together with the top edge of the lift-out grill.

As an additional device of the security system, a single ⅛ inch, or greater, diameter rough galvanized steel nail or locking stud 60, as shown in FIGS. 1, 2 and 6, is used to secure the rolling door 11 in one to six open positions and one closed position. The stud 60 is interposed along the center line of the over-lap between the doors 11 and 12 when they are in closed position. As moving door 11 is moved to the right, the stud 60 is used to secure the door at each of a series of different openings corresponding to the holes 61, 62, 63, 64, 65, 66, and 67 of the top rail 17 of door 11, but always at the left frame of the fixed door 12; therefore, only one hole 68 is required in the inside flange of track 13*a*.

The outer flange of top track 13*a*, the top rail 17 of door 11, the inner flange of track 13*a*, the inner flange of track 13*b* and the top rail of door 12 are all drilled with holes which are horizontally aligned when doors 11 and 12 are in closed positions.

Figure 3:
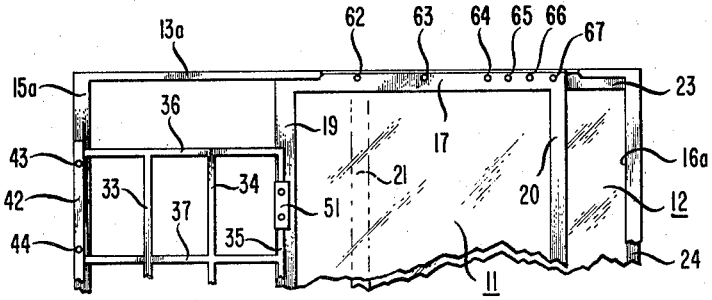
FIG. 3 is a fragmentary showing in side elevation of the upper portion of FIG. 1, including perforations along the top edge of the door which are designed to receive the locking stud in different positions of the sliding door.

As shown in FIG. 3, in which the inside flange of channel 13*a* is partially broken away, the perforations 61 (not shown) and 62, 63, 64, 65, 66 and 67 of the top rail 17 of door 11 are each 3/16 inch in diameter. As door 11 is slid back and forth on track 13*a*, all seven of the perforations 61–65 are successively placed in alignment with the central opening 68 in the inner flange of the track 13*a*, and horizontally aligned openings in its outer flange, in the inner flange of track 13*b*, and opening 69 near the left-hand edge of door 12. It will be noted that there is no corresponding opening in the outer flange of track 13*b* so that the stud 60 will not be visible from the outside.

When the moving door 11 is at an opening corresponding to any one of the seven hole positions 61–67, it may be secured by the stud 60, which is securely attached to the inner wall or some other point inside of the door frame (see FIG. 1). The connecting cable 70 must be long enough so that it may be interposed through hole 69 to lock the door 11 in any of the seven positions indicated in FIG. 2. A particular feature of the stud or pin 60 is that it is of round section, and rough faced. The hole is approximately horizontal or sloping slightly downward from the inside of the room toward the outside to cause increased tightness of the pin or stud in its locking hole as the potential intruder jiggles the sliding door.

Thus, in accordance with the present illustrative embodiment of the invention, the doors 11 and 12 may be completely closed and locked with the stud 60 interposed in hole 61 in door 11 and aligned hole 69 in door 12. Alternatively, door 11 may be locked at any of the opening positions corresponding to the locking stud holes 62–67. When the grill 31 is in place at the widest secured opening, being accommodated between the channel 42 on the left-hand door frame, and the aligned channels 51, 52, 53 and 54 on the door stile 19, the hole 62 of door 11 is aligned with hole 69 of door 12 and stud 60 is fastened in place. Also, the lug 59 engages the under surface of the door handle 25. A potential intruder has no way to determine from the outside where the locking stud has been applied, or how the grill 31 is fastened in place in the door opening.

In combination with the other features of the invention, in order to prevent the movable door 11 from being lifted out of the lower double track 14*a*, 14*b*, having the form shown in FIGS. 8A, 8B, the latter can be modified in a manner shown in FIGS. 9 and 10. This is an expedient well known in the art in which the central flange of FIGS. 8A, 8B is replaced by a pair of rails 74*a* and 74*b*, which engage and ride in recesses in the lower rails 18 and 22 of the respective doors 11 and 12.

In accordance with the present invention, another device for preventing the moving door 11 from being lifted off of the track 14*a* is to provide a rod or tube 76, preferably of aluminum, ½ inch square in cross-section, which is mounted in the trough or channel 13*a* (see FIG. 12) approximately 10 inches from the left-hand door jamb 15*a*, and extending laterally to the right so that its right-hand end extends about 4½ inches beyond the maximum security opening of door 11 which is approximately 25½ inches. The square rod or tube 76 is designed to be secured to the inner top surface of channel 13*a* by a pair of upwardly projecting flat head bolts 77 and 78, each being 2 inches in from its respective end. Thus, one of the bolts is between the two doors 11 and 12, and never available to an intruder, even when the door is opened to a maximum security opening of 25½ inches. Neither of the bolts is available to an intruder when the door is opened only 4½ inches, or closed.

Figure 13A:
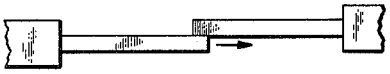
Figure 13B:
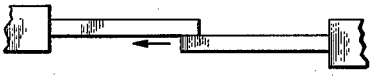
Figure 13C:
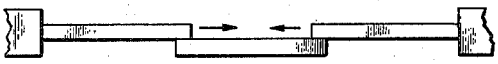
Figure 13D:
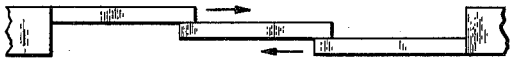
Figure 13E:
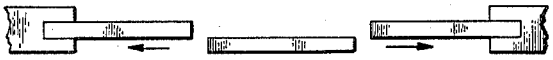

Although the invention has been described in detail with reference to a particular arrangement of glass doors mounted in a double track in which one door 12 is closed, and the other door 11 opens by moving to the right adjacent the inner surface of 12 (see FIG. 13A), it will be apparent to those skilled in the art that with slight modification, the present invention can be adapted to sliding doors of other arrangements, such as that shown in FIG. 13B in which the fixed outer door is on the left, and the sliding door moves to the left to open. In another alternative shown in FIG. 13C suitable for the system of the present invention, a fixed inner door is flanked at its two ends by a pair of sliding doors which are opened by sliding them toward one another across the inner face of the fixed door. In another alternative shown in FIG. 13D, the lateral sliding doors are opened by respectively moving them in opposite directions across the inner and outer surfaces of the fixed central door. In still another arrangement shown in FIG. 13E, the central door is fixed, and the lateral door panels are moved in opposite directions to open, away from the ends of the fixed door and into recesses in the opposite walls. It will be apparent that each of the arrangements shown are suitable for installation of the security system of the present invention, as are similar window arrangements. For example, it will be understood that more than one security grill could be used in the arrangements of FIGS. 13C, 13D and 13E in cooperation with each of the movable doors. Other arrangements will occur to those skilled in the art.

It is necessary to remove sliding doors and windows for rare occasions of repair of frames, glass, panels or their tracks. Therefore, the vertical heights of the fixed and sliding frames are shorter than the total distance from the upper edge of the lower track to the true ceiling of the upper track, thereby permitting the fixed and the sliding frames to be raised up into the extra deep upper track so that they clear the upper edge of the lower track. Then the frame can be pulled or pushed out or in, clear of its lower track; or lowered and cleared of its upper track. Thus, the frame is completely removable for any purpose such as repair, replacement or entrance by an intruder. These essential features are most commonly overlooked or not realized by occupants; but not so by potential intruders. The latter may use a strong flat tool, such as a screwdriver or tire-iron, to lift either the screwed-in-place fixed frame, or more easily, to lift the sliding frame, which is not screwed in place but only has a very small indoor latch, and which automatically unlatches when the sliding frame is lifted at the latch-end, approximately one-quarter to one-half inch.

In accordance with one prior art method, a small percentage of occupants attempt to keep intruders out by installing a stud, bolt or screw vertically in the upper track with its exposed end extending down one-quarter to one-half inch below the ceiling of this upper track at the latch-end of the sliding frame. This attempts to prevent the intruder from lifting the frame up sufficiently to unlatch the extremely small, weak latch. However, a common screwdriver can snap these latches into a non-effective shape from outdoors by prying the sliding door open, thus making stud, bolt or screw completely inaffective by sliding the door frame as previously described. A fairly common prior art practice by more knowledgeable occupants is to lay a horizontal long rod, tube or stick of wood, or the like, in the bottom track of the sliding frame to fully occupy the track length from the sliding frame to the distant wall, a length approximately equal to that of the fixed frame. Frequently such a rod, tube or stick is longer than need be, one end being raised two to six inches, so that it is more easily lifted out by the occupant and inherently seen by intruders. Some occupants also have an alternative rod, tube or stick which is four to five inches shorter to permit a ventilation opening of that width by the sliding door. One end of such a rod may be raised for ease of lifting it out.

It is possible for an intruder to counteract the above described method by using a large screwdriver or tire-iron type of tool to force the fixed frame up, and then push, or lift and push, the horizontal rod, tube or stick out of place, snap the latch of the sliding frame, and slide the latter frame fully open. Such rods, tubes or sticks are so easily seen from the outside that the intruder is encouraged to attempt to enter.

It is a particular advantage of the security locking system of the present invention, in its various disclosed ramifications, herein disclosed, that it cannot be seen from the outside by an intruder, nor is he able to use tools to lift the fixed or sliding frame from the track secured in the manner taught by the present invention.

The invention is not limited to the specific forms or dimensions shown and described by way of example, but only by the scope of the appended claims.

What is claimed is:

1. A security system assembly in accordance with the present invention designed for installation in an arrangement of one or more laterally rolling or sliding doors or windows mounted in a door or window frame comprising substantially aligned upper and lower parallel tracks, and vertical door or window jamb casings at opposite edges of said frame, which assembly comprises in combination:

at least one lift-out grill comprising a plurality of horizontal and vertical bars rigidly fastened together;

an elongated channel substantially colinear with and constructed to accommodate a first one of said vertical bars adjacent one periphery of said grill, said channel secured to the inner flange of one said vertical door or window jamb casing;

a plurality of short channels secured in vertical alignment adjacent a peripheral vertical edge of one of said rolling or sliding doors or windows, which edge is constructed to close against said one door or window jamb casing;

said short channels being constructed to accommodate a second one of said vertical bars adjacent the opposite periphery of said grill, or in alternation, one or more vertical bars disposed intermediate to said first and second peripheral bars; and wherein said short channels are each positioned between one pair of the horizontal bars of said grill and are dimensioned not to exceed the distance between said pair of bars.

2. The combination in accordance with claim 1:

wherein said one rolling or sliding door or window has a substantially vertically-disposed handle supported near the center of said peripheral vertical edge by support means having a horizontally-disposed opening beneath said handle;

and wherein the said first vertical bar of said grill has fixed thereto a horizontally-directed lug constructed to engage the horizontally-disposed opening beneath the handle of said one rolling or sliding door or window when said one door or window is opened to the maximum width of said grill.

3. The combination in accordance with claim 2:

wherein at least one of said intermediate bars includes a horizontally-directed lug constructed to engage the horizontally-disposed openings beneath said handle when said one door or window is opened to a width corresponding to the position at which said intermediate bar engages said short channels.

4. The combination in accordance with claim 1:

wherein, in at least one preselected position along the upper door or window frame casing corresponding to a position in which two of said doors or windows, including said one rolling or sliding door or window, are constructed to be closed in slightly overlapping relation; and wherein said doors or windows in closed position and all of the upwardly projecting flanges of said upper door-frame track, except the outer flange of the outer track, include horizontally aligned holes; and a stud connected by flexible connecting means to a point adjacent said door or window frame, said stud being constructed to pass through and fit into said horizontally aligned holes thereby locking said doors or windows in said closed position.

5. The combination in accordance with claim 4:

wherein said one rolling or sliding door or window includes, in addition to the hole aligned with said horizontally aligned holes in closed position, a plurality of horizontally directed holes in spaced-apart relation along the upper edge of said one rolling or sliding door or window; and wherein when said one rolling or sliding door or window is moved in a direction to open, each of said holes is aligned in succession with said horizontally aligned holes in said flanges, whereby said rolling or sliding door or window is constructed to be secured in locked relation at each of a series of openings corresponding to the maximum and lesser openings secured by said grill.

6. The combination in accordance with either of claims 4 or 5 in which said stud has a rough metal surface.

7. The combination in accordance with any of claims 1–6 in which an auxiliary bar of rectangular cross-section is secured in the upper track of said door or window frame above said sliding or rolling door or window;

said auxiliary bar extending horizontally along said track from a first position separated from said one vertical door jamb by a horizontal distance less than the minimum opening designed to be secured by said grill to a second position separated from said one vertical door jamb by a horizontal distance which at least exceeds the maximum opening designed to be secured by said grill.

8. The method of securing a door or window in partially open position which is mounted to roll or slide laterally in a door or window frame comprising opposing vertical door or window jambs and a pair of substantially parallel upper and lower tracks, which comprises the steps of;

securing an elongated channel along the internal edge of one said vertical door or window jamb opposite the open edge of said door or window, securing a plurality of short channels spaced apart in vertically aligned relation along the open edge of said door or window, interposing a grill comprising a plurality of vertical and horizontal bars in the opening intervening between the open edge of said door or window and said one door or window jamb so that the vertical bar on one periphery of said grill is accommodated in said elongated channel and one of the other vertical bars of said grill is accommodated in said vertically aligned short channels.

9. The method in accordance with claim 8:

including the steps of providing said open door or window near its open edge with a handle including a substantially horizontally-extended opening, and providing at least one of the vertical bars of said grill with a horizontally-disposed lug which is engaged with the horizontally-extended opening of said handle when said vertical bar is accommodated in said aligned short channels.

10. The method in accordance with claim 8:

including the steps of providing the inner flange of said upper track with a series of perforations in lateral spaced-apart relation, providing said door or window with a perforation near its upper inner edge which is in successive horizontal alignment with the perforations of said upper track at openings of said door or window between the minimum and maximum width of said grill, interposing a stud in a selected perforation of said door or window and in an aligned perforation on said upper track for securing said door or window at a preselected opening, secured by said grill.

11. The method in accordance with claim 8:

including the step of securing wherein a rod of substantially rectangular cross-section into said upper track above said door so that said rod extends from a point of opening of said door or window less than the minimum opening secured by said grill to a point of opening exceeding the maximum width secured by said grill.

* * * * *